United States Patent [19]

Nilsson

[11] Patent Number: 4,637,445

[45] **Date of Patent: * Jan. 20, 1987**

[54] ARRANGEMENT IN VENETIAN BLINDS

[76] Inventor: Berndt R. Nilsson, Adolf Fredriksgatan 6, S-217 74 Malmö, Sweden

[ * ] Notice: The portion of the term of this patent subsequent to Jul. 30, 2002 has been disclaimed.

[21] Appl. No.: 732,099

[22] Filed: May 9, 1985

Related U.S. Application Data

[62] Division of Ser. No. 403,084, Jul. 29, 1982, Pat. No. 4,531,563.

[30] Foreign Application Priority Data

Aug. 7, 1981 [SE] Sweden ..... 8104739

[51] Int. Cl.[4] ..... E06B 9/30

[52] U.S. Cl. ..... 160/178 C; 160/168 R

[58] Field of Search ..... 160/168, 176, 177, 178 C

[56] References Cited

U.S. PATENT DOCUMENTS

| | | | |
|---|---|---|---|
| 2,744,572 | 5/1956 | Lorentzen | 160/178 C |
| 3,040,403 | 6/1962 | Viol et al. | 160/178 C |
| 3,333,905 | 8/1967 | Hennequin | 160/177 |
| 3,918,513 | 11/1975 | Englund | 160/176 R |
| 3,952,789 | 4/1976 | Marotto | 160/168 R |
| 4,327,797 | 5/1982 | Nakajima et al. | 160/178 C |
| 4,531,563 | 7/1985 | Nilsson | 160/168 |

*Primary Examiner*—Ramon S. Britts
*Assistant Examiner*—Cherney S. Lieberman
*Attorney, Agent, or Firm*—Barnes, Kisselle, Raisch, Choate, Whittemore & Hulbert

[57] ABSTRACT

A Venetian blind has U-shaped mounting rail with lead-in holes for ladder-tapes, cords and slat operating means. The Venetian blind comprises an operating shaft and bearing blocks, bearing bushings hold-down means, a driving device therefor, and a cord lock. These details are designed as snap-in components adapted to be mounted in said mounting rail without necessitating the use of any special mounting means. The operating shaft is non-rotatable relative to and extends through the bearing bushings and is locked against axial displacement, on the one hand by means of an abutment face provided on said hold-down means at one shaft end and, on the other hand, by means of the shaft driving device at the other end of the shaft.

2 Claims, 10 Drawing Figures

Fig. 1A
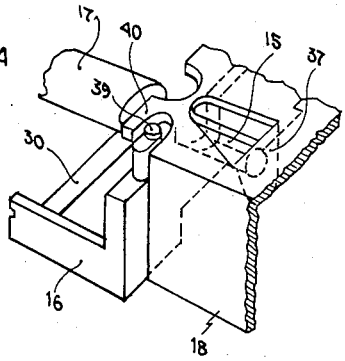
Fig. 1
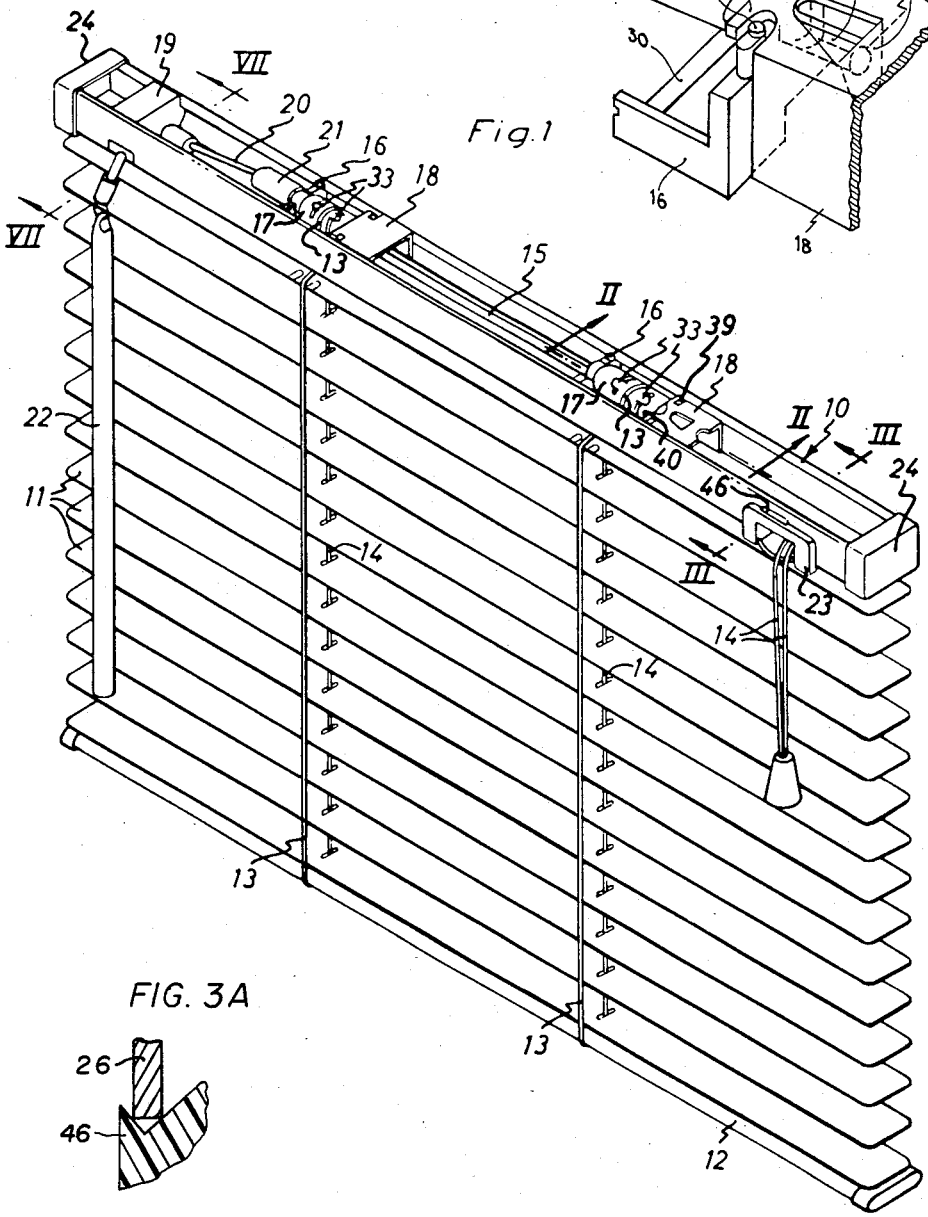
FIG. 3A

ARRANGEMENT IN VENETIAN BLINDS

This application is a division of application Ser. No. 403,084 filed July 29, 1982, now U.S. Pat. No. 4,531,563.

The present invention relates to an arrangement in Venetian blinds comprising a substantially U-shaped mounting rail with bent legs and lead-ins for the ladder-tapes, cords and slat operating means, the arrangement further comprising bearing blocks inserted in the mounting rail and adapted to support an operating shaft mounted in said bearing blocks by means of bearing bushes and held in position by hold-down means, said operating shaft being connected with the ladder-tapes and adapted to control the angular position of said ladder-tapes and, thus, the angular position of the slats, the operating means of said arrangement comprising a driving device for said operating shaft and a cord lock.

Venetian blind arrangements of this type are well known and in common use. However, the known Venetian blind arrangements are difficult to set up and utilize a number of screw connections for anchoring the various components in the mounting rail and locking the operating shaft relative to the bearing bushings and their attachments for the ladder-tapes.

The present invention has for its object to provide a novel Venetian blind arrangement which greatly facilitates setting-up and requires far less components and operating moments for fitting the various details.

To this end, the Venetian blind arrangement according to the present invention is characterized in that the bearing blocks, the hold-down means, the driving device and the cord lock are formed as snap-in components adapted to be mounted in said mounting rail without necessitating the use of any special mounting means; and that said operating shaft is non-rotatable relative to and extends through the bearing bushings and, at one end, is locked against axial displacement by means of an abutment face on the hold-down means of the bearing bushings located at this end and, at its other end, is locked against axial displacement by means of its driving device.

When the bearing bushings have a bearing sleeve made of plastic material and an attachment sleeve extending around said bearing sleeve and adapted to secure the ladder-tapes to the bearing bushings, it is preferred, according to an especially advantageous embodiment of the invention, to form the attachment sleeve with internal keys serving as cutting edges and to push the attachment sleeve over the bearing sleeve, while simultaneously forming keyways in said bearing sleeves by means of their keys serving as cutting edges. In this manner, a reliable key connection is established between the bearing sleeve and the bearing bushings, whereby the usual clamping screws for clamping the attachment sleeve to the bearing bushings and for clamping the bearing bushings to the operating shaft can be dispensed with. The use of such a key connection may make the shaft displaceable relative to the bearing bushings, but such displacement is prevented by the above-mentioned abutment face on one of said hold-down means and the driving device.

In another advantageous embodiment of this invention, the mounting rail has a mounting hole for the cord lock, said hole extending on either side of the corners of the mounting rail between the web of the U-shaped rail and one leg thereof. The mounting of the cord lock is effected from the inner side of the mounting rail, and the lock is provided with snap-in means which can be inserted through said mounting hole only by deformation of said snap-in means and/or said mounting rail and, after mounting, engage the edge portions of said mounting hole. Furthermore, the cord lock has abutment faces engaging with the inner side of the mounting rail for substantially maintaining the snap-in means in engagement with the said edge portions. The cord lock, by being designed in this manner, will be snapped to the mounting rail in a nondetachable manner. In this embodiment of the invention, it is especially advantageous if the cord lock is formed with a hook portion adapted, after mounting, to engage behind the bent flange portion of the mounting rail on one leg of said U-shaped rail.

In another and especially advantageous embodiment of the invention, the hold-down means are formed as U-shaped elements, the webs of which after mounting straddle the mounting shaft at the bearing blocks, while the legs of these elements extend down into the mounting rail and have protruding detents for engagement with the inner end of the bent flange portion of the U-shaped mounting rail on the legs thereof. Furthermore, said U-shaped elements are provided with means for fixing the position of the hold-down means relative to the bearing blocks. The hold-down means having an abutment face for engagement with one end of the operating shaft may be provided with a bent locking tongue serving as the said abutment face.

An embodiment of the invention will be described in more detail in the following, reference being had to the accompanying drawings in which:

FIG. 1 is a perspective view of an example of a Venetian blind arrangement according to the invention;

FIG. 1A is a fragmentary perspective view on an enlarged scale of a portion of the Venetian blind arrangement shown in FIG. 1.

FIG. 3A is a fragmentary sectional view on an enlarged scale of a portion of the Venetian blind arrangement shown in FIG. 3.

Figure 4:
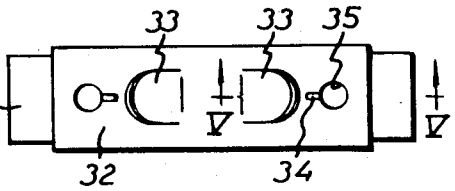
FIG. 4 is a plan view of a bearing sleeve with attachment means as comprised by the arrangement according to the invention.

The Venetian blind arrangement according to the present invention is provided, in known manner, with a mounting rail 10 and slats 11 and a sub-rail 12 which are supported by ladder-tapes 13 and can be raised and lowered by means of cords 14.

The mounting rail comprises an operating shaft 15 for the ladder-tapes. The operating shaft is mounted in bearing blocks 16 by means of bearing bushings 17 and is held in position in said bearing blocks by hold-down means 18. The shaft is connected at one end with a driving device 19 via a flexible shaft 20 and a shaft coupling 21. The driving device is in the form of a worm gear, the worm shaft of which protrudes from the mounting rail and is connected to an operating bar 22. FIG. 1 also shows a lock 23 for the cords 14 and end protection means 24 for the ends of the mounting rail.

The illustrated embodiment of the Venetian blind arrangement according to this invention will now be described in greater detail with reference to FIGS. 2–8 of the drawings.

As has been mentioned above, the bearing blocks 16, the hold-down means 18, the driving device 19 and the cord lock 23 are formed as snap-in components that can be mounted in the mounting rail without any special tools. The different components will now be described separately in the following.

Figure 3:
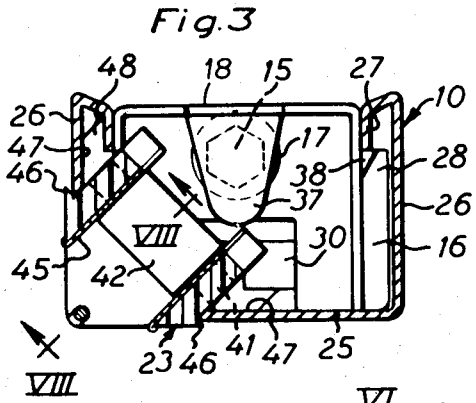
FIG. 3 is a section along line III—III in FIG. 1, the cords and slats having been omitted.

As will appear from e.g. FIG. 3, the mounting rail 10 is formed as a U-shaped rail having a web 25 and legs 26 bent back upon themselves, the bent flange portion 27 of which has its end edge facing downwardly and at a distance from the legs of the U.

Figure 6:
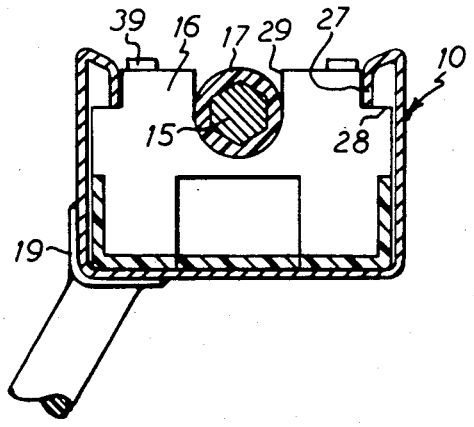
FIG. 6 is a section along line VI—VI in FIG. 2.

As has also been mentioned above, the operating shaft 15 is mounted for rotation in the bearing blocks 16 by means of the bearing bushings 17 and the hold-down means 18. FIG. 6 shows how the end portions of the bearing blocks are formed, and it will be seen that they are provided with detents 28 for engagement with the edge of the bent flanges 27 of the rail 10. It also appears from this Figure that the bearing blocks are provided in their end portions with U-shaped recesses 29 forming a bearing surface for the bearing bushings 17. Furthermore, the bearing blocks 16 are provided with a guide roller 30 (FIG. 2) over which the cords of the Venetian blind are passed througn lead in holes 31 in the mounting rail 10.

Figure 5:
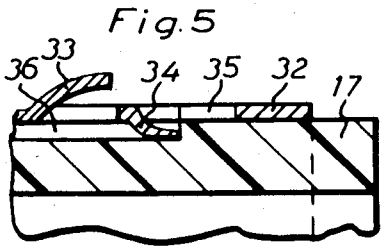
FIG. 5 is a section along line V—V in FIG. 4.
Figure 2:
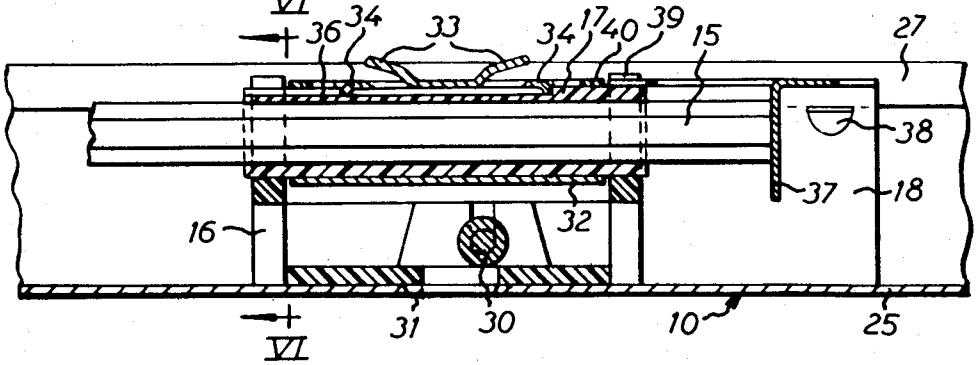
FIG. 2 is a section along line II—II in FIG. 1, the cords and slats having been omitted.

In the embodiment illustrated, the shaft 15 is of hexagon cross-section to make it non-rotatably connectible with the bearing bushings 17 which, within at least a portion of their shaft take-up passage, are of corresponding hexagon cross-section. The bearing bushings 17 are each provided with an attachment sleeve 32 which is pushed over the bearing bushing and keyed thereto. The details of this construction are shown in FIGS. 2, 4 and 5. The bearing bushing 17 consists in this embodiment of plastic material, while the attachment sleeve 32 pushed thereover is made of metal. The attachment sleeve has bent-out attachment lugs 33 for securing the ladder-tapes which also extend up through the holes 31. Neither the ladder-tapes nor the cords are shown in FIG. 2. In known Venetian blind arrangements, the attachment sleeve has been connected with the bearing bushing by means of stop screws. In the embodiment most preferred and here described, the non-rotatable connection between the bushing 17 and the sleeve 32 is obtained by providing the attachment sleeve 32 with bent-in cutting edges 34 which serve as keys and in front of which a hole 35 has been formed. When the bearing bushing 17 and the attachment sleeve 32 are mechanically pushed together, the leading cutting edge 34 will cut a keyway 36, whereby the two components are reliably keyed together.

Since the screw connection or stop screw previously utilized for securing the attachment sleeve 32 to the bearing bushing 17 has been eliminated, the shaft 15 will be axially movable through the bearing bushings 17, unless the arrangement is dimensioned with a press fit. To eliminate the risk that the operating shaft 15 may slide out of the bearing bushings provided at the ends, the displaceability of the operating shaft has been blocked by providing the hold-down means 18 at the free shaft end with a bent-down locking tab 37. The other end of the shaft is locked against axial displacement in that the end is connected, by means of the shaft coupling 21 and the flexible shaft 20, with the driving device or gear 19 which is non-displaceably mounted in the mounting rail 10.

As has been mentioned before, the hold-down means are U-shaped. This is shown in FIGS. 2 and 3 from which it will also be seen that the legs of said hold-down means are provided with bent-out locking lugs 38 for engaging the edge of the bent flange 27 of the mounting rail. By comparing FIGS. 1 and 2, it will also be seen how the hold-down means 18 are connected with the bearing blocks 16 which have projecting pins 39 for engagement with small hooks 40 on the webs of the hold-down means. In this manner, the hold-down means prevent the bearing bushings and thus the operating shaft from disengaging themselves from the bearing blocks 16.

Figure 8:
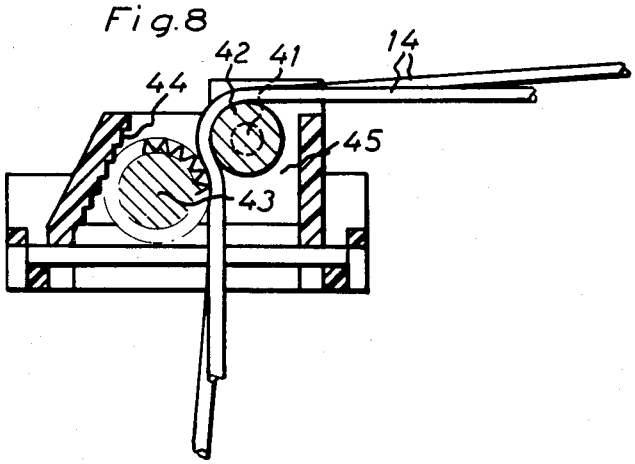
FIG. 8 is a section along line VIII—VIII in FIG. 3.

FIGS. 3 and 8 show how the cord lock 23 is designed and mounted in the mounting rail 10. The cord lock has, in known manner, a roller 42 mounted on a shaft 41 and cooperating with a loosely mounted knurled roller 43 which also may be in the form of a gear wheel. The roller 43 which is knurled or in the form of a gear wheel, cooperates with a similarly inclined surface 44 in the cord lock and can thus be made to clamp the cords in any desired vertical position. In the embodiment illustrated, the cord lock is formed substantially of plastic material, and to protect the plastic material against wear by the loosely mounted roller 43, a thin sheet-metal lining 45 has been provided on the internal wall portions engaging with the end faces of the loosely mounted roller.

According to the invention, the cord lock is mounted in a mounting hole extending on either side of the corner between the web 25 and one leg 26. According to the invention, the cord lock 23 is inserted for mounting in the mounting rail from the inner side of said rail. To this end, the cord lock is provided with snap-in means 46 which are adapted, after mounting, to engage with the edge portions of the mounting hole. Furthermore, the cord lock has abutment faces 47 engaging with the inner side of the mounting rail and adapted to maintain the snap-in means 46 substantially in engagement with the said edge portions after mounting. In the embodiment illustrated, the abutment faces are extended outwards into a hook portion 48 which is adapted, after mounting, to engage behind the bent flange portion 27 of the mounting rail on one leg 26 of said rail. This is shown in FIG. 3. The snap-in means and the abutment faces are so located and dimensioned relative to the said mounting hole of the mounting rail 10 that the cord lock can be mounted in the rail solely by deformation of the snap-in means and/or the mounting rail. As a result, the cord lock can be permanently mounted in the mounting rail in a simple manner and cannot be removed therefrom without being damaged.

Figure 7:
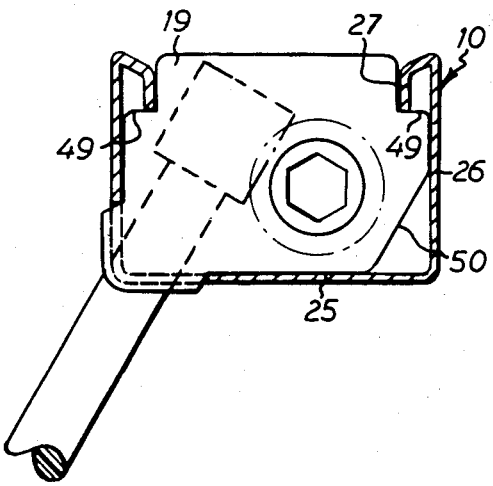
FIG. 7 is a section along line VII—VII in FIG. 1.

FIG. 7, finally, shows how the driving device or worm gear for operating the ladder-tapes is mounted in the mounting rail 10. Also this rail is formed for snap-in action and therefore has shoulder portions 49 which, after mounting, engage with the edges of the flange portions 27. Also the driving device protrudes through a mounting hole which extends on either side of one corner of the mounting rail. To facilitate mounting, the driving device has an inclined surface 50. As will be seen from FIG. 7, the geometrical axis of the worm wheel of the driving device is offset relative to the mounting shaft 15, and this is why the flexible shaft 20 shown in FIG. 1 is required.

What I claim and desire to secure by Letters Patent is:

1. An arrangement in Venetian blinds comprising a substantially U-shaped mounting rail with a web and bent legs and lead-ins for the ladder-tapes, cords and slat operating means, the arrangement further comprising means in the mounting rail for supporting an operating shaft, said operating shaft being connected with the ladder-tapes and adapted to control the angular position of said ladder-tapes and, thus, the angular position of the slats, the operating means of said arrangement comprising a driving device for said operating shaft and a cord lock, wherein said mounting rail has a mounting hole for the cord lock, said mounting hole extending into the web and one leg on either side of the corner of the mounting rail between the web of the rail and said one leg of said rail, and wherein said cord lock is insertable in said mounting rail from the inner side thereof and has snap-in detent means adapted to be moved through said mounting hole solely under deformation of said snap-in detent means and/or said mounting rail for engaging, after mounting, with the edge portions of said mounting hole on either side of said corner; and wherein said cord lock also has abutment faces engaging with the inner side of said one leg and web of said mounting rail and adapted to maintain said snap-in detent means substantially in engagement with said edge portions.

2. An arrangement as defined in claim 1 wherein said one leg of said rail is turned inwardly at its outer extremity to provide a bent flange portion which extends toward said web in spaced relation to said one leg and which terminates in an inner edge spaced from said web, the cord lock having a hook portion adapted to engage, after mounting, behind said bent flange portion.

* * * * *